US005659860A

United States Patent [19]

Sasaki et al.

[11] Patent Number: 5,659,860

[45] Date of Patent: Aug. 19, 1997

[54] DEVELOPING DEVICE FOR AN IMAGE FORMING APPARATUS AND TONER CARTRIDGE

[75] Inventors: Fumihiro Sasaki, Fuji; Satoshi Mochizuki, Numazu; Hidefumi Gohhara, Numazu; Megumi Sakakura, Numazu; Seiji Oka, Yokohama; Hajime Oyama, Ichikawa; Kiyonori Tsuda, Tokyo; Yasushi Akiba, Chiba, all of Japan

[73] Assignee: Ricoh Company, Ltd., Tokyo, Japan

[21] Appl. No.: 538,222

[22] Filed: Oct. 3, 1995

[30] Foreign Application Priority Data

| | | | |
|---|---|---|---|
| Oct. 4, 1994 | [JP] | Japan | 6-240402 |
| Oct. 26, 1994 | [JP] | Japan | 6-285871 |
| Nov. 4, 1994 | [JP] | Japan | 6-295800 |
| Jul. 14, 1995 | [JP] | Japan | 7-201454 |

[51] Int. Cl.[6] ..... G03G 15/09

[52] U.S. Cl. ..... 399/267

[58] Field of Search ..... 355/245, 251, 355/253, 260, 215; 118/653, 656, 657, 658; 430/105, 106.6, 107, 108; 399/252, 264, 267, 272, 277, 276

[56] References Cited

U.S. PATENT DOCUMENTS

| | | | |
|---|---|---|---|
| 4,937,628 | 6/1990 | Cipolla et al. | 355/260 |
| 5,095,339 | 3/1992 | Terashima | 355/251 |
| 5,267,003 | 11/1993 | Grappiolo | 355/260 |
| 5,267,007 | 11/1993 | Watanabe et al. | 355/245 |
| 5,395,717 | 3/1995 | Ozawa et al. | 430/106.6 |
| 5,525,752 | 6/1996 | Izumizaki et al. | 118/658 |

FOREIGN PATENT DOCUMENTS

| | | |
|---|---|---|
| 59-200276 | 11/1984 | Japan . |
| 62-47074 | 2/1987 | Japan . |
| 62-178278 | 8/1987 | Japan . |
| 1-222281 | 9/1989 | Japan . |
| 2-251875 | 10/1990 | Japan . |

*Primary Examiner*—Sandra L. Brase

*Attorney, Agent, or Firm*—Oblon, Spivak, McClelland, Maier & Neustadt, P.C.

[57] ABSTRACT

In an image forming apparatus, a developing device has a developing sleeve accommodating a magnet roller therein, and a doctor for regulating the amount of developer to be conveyed to a developing position. When the developing sleeve is rotated, the part of the doctor shaved off by the doctor from the sleeve is moved in a developer storing section to a toner replenishing opening formed in a toner storing section. Then, this part of the developer is returned to the doctor along the surface of the sleeve via the toner replenishing opening. The developer consists of a first developer containing a first carrier and deposited in a layer on the surface of the sleeve, and a second developer containing a second carrier different from the first carrier and stored in the developer storing section in such a manner as to contact the first developer deposited on the sleeve. The first carrier has a higher charging ability than the second carrier. The device does not need a toner replenishing mechanism or a toner concentration sensor and has, therefore, a miniature and inexpensive construction. In addition, the device is applicable even to a high-speed image forming apparatus.

20 Claims, 5 Drawing Sheets

DEVELOPING DEVICE FOR AN IMAGE FORMING APPARATUS AND TONER CARTRIDGE

BACKGROUND OF THE INVENTION

The present invention relates to a copier, facsimile apparatus, printer or similar electrophotographic image forming apparatus and, more particularly, to a developing device for an image forming apparatus, and a toner cartridge.

A latent image electrostatically formed on an image carrier is usually developed by either a method using toner, or single-ingredient type developer, or a mixture of toner and carrier or two-ingredient type developer. Typical of this kind of developing method is a magnet brush developing method as disclosed in, e.g., U.S. Pat. No. 2,874,063. In the two-ingredient type developer, fine toner particles are retained on the surfaces of comparatively great magnetic carrier particles due to an electrostatic force generated by friction. When this type of developer approaches a latent image, the force of an electric field formed by the latent image and attracting the toner toward the latent image overcomes the force coupling the toner and carrier. As a result, the toner develops the latent image to produce a corresponding toner image. The prerequisites with the method using the two-ingredient type developer is that fresh toner be replenished in order to make up for consumption and to maintain the toner and carrier in a constant mixture ratio, i.e., to maintain a toner concentration constant. These prerequisites cannot be met without resorting to a toner replenishing mechanism, toner concentration sensor, and so forth, resulting in a bulky developing device and complicated mechanisms.

In light of the above,. Japanese Patent Publication No. 5-67233, for example, teaches a developing device using a two-ingredient type developer and eliminating the need for toner concentration control. In this developing device, a developer around a developer carrier automatically takes in fresh toner at a toner replenishing position. A regulating member charges the toner while regulating the amount of the developer. Therefore, the device is capable of charging the toner while maintaining the toner concentration of the developer constant without resorting to a toner replenishing mechanism or a toner concentration sensor.

It has been customary with an electrophotographic image forming apparatus to uniformly charge a photoconductive element or image carrier, illuminate the surface of the charged element with imagewise light to thereby form a latent image, develop the latent image with toner fed from a developing device, transfer the resulting toner image from the element to a paper, and then fix the toner image on the paper. In this type of apparatus, means for replenishing the toner to the developing device is often implemented as a toner cartridge removably mounted to, e.g., a toner tank included in the developing device. Japanese Patent Laid-Open Publication No. 60-41068, for example, proposes a toner cartridge whose outlet is closed by a seal member when the cartridge is not used. This kind of cartridge is mounted to an image forming apparatus after the seal has been removed from the cartridge. Also, Japanese Patent Laid-Open Publication No. 60-21070 teaches an arrangement wherein a cover slidable in the same manner as a cover for covering a developing roller, or developer carrier, selectively opens or closes an outlet formed in a toner cartridge.

The apparatus disclosed in the above Patent Publication No. 5-67233 has some problems yet to be solved, as follows. In order to desirably transfer the fresh toner to the developer carried on the developer carrier, the amount of developer cannot be increased, compared to a conventional apparatus using a two-ingredient type developer. Hence, when the apparatus is applied to a high-speed apparatus having a developer carrier whose surface moves at a high linear velocity, the toner cannot be sufficiently charged and is, therefore, apt to contaminates the background of an image. When the regulating stress of the regulating member is increased in order to sufficiently charge the toner, the developer particles impinge on each other and generate heat. The heat causes the toner to form films on the surfaces of the magnetic particles, thereby causing the developer to be spent. As a result, the charging characteristic of the magnetic particles is sequentially deteriorated to such a degree that the toner flies about and contaminates the background.

On the other hand, development using a single-ingredient type developer or toner causes the toner to deposit on the surface of a developer carrier due to an electrostatic force generated by friction between the toner and the developer carrier, or due to a magnetic force generated between the toner and the developer carrier. Of course, for the magnetic force scheme, use is made of toner containing a magnetic substance, and a developer carrier accommodating magnets therein. When the toner approaches a latent image, a force generated by an electric field formed by the latent image and attracting the toner toward the latent image overcomes a force coupling the toner and developer carrier. As a result, the toner develops the latent image. This kind of development does not have to control the toner concentration and, therefore, reduces the size of the developing device. However, because the number of toner particles in a developing region is smaller than the number available with the two-ingredient type development, the amount of toner to deposit on the latent image is too small for the device to be applied to a high-speed apparatus.

In order to achieve a miniature developing apparatus using a two-ingredient type developer, an arrangement may be made such that toner is circulated around and along a developer carrier together with a carrier. This allows the toner to be charged by friction and introduced into the developer. However, the prerequisite with this arrangement is that a relatively small amount of carrier be deposited on the developer carrier in order to insure the migration of the toner into the developer. The life of a developer is proportional to the amount of carrier, as well known in the art. When the amount of carrier deposited on the developer carrier is small, as mentioned above, the deterioration of the developer is accelerated due to repeated agitation, circulation, or conveyance. This, coupled with the noticeable melting of the toner, results short charging and thereby reduces the life of the developer.

The toner cartridge and image forming apparatus operable therewith as taught in the previously mentioned Laid-Open Publication No. 60-41068 has the following drawbacks. When the seal member is removed from the cartridge to be mounted to the apparatus or is disposed of later, the toner is apt to smear the operator's hand, clothing or the like even if the operator handles the cartridge with care. This is also true with the cover scheme of the Laid-Open Publication No. 60-21070. Specifically, when the cover is opened, the toner deposited on the rear of the cover is transferred to the cartridge and therefrom to the operator's hand, closing or the like.

SUMMARY OF THE INVENTION

It is, therefore, an object of the present invention to provide a miniature and inexpensive developing device not needing a toner replenishing mechanism or a toner concentration sensor, and capable of sufficiently charging toner even when applied to a high-speed image forming apparatus.

It is another object of the present invention to provide a developing device capable of preventing the life of a developer from being reduced even when an amount of developer to be deposited on a developer carrier is smaller than conventional.

It is a further object of the present invention to provide a toner cartridge which can be easily and surely mounted to an image forming apparatus without complicating the structure or smearing the operator's hand, clothing or the like, and an image forming apparatus operable therewith.

In accordance with the present invention, a developing device has a developer carrier having a magnetic field forming member therein, and for conveying a developer consisting of toner and magnetic particles deposited on its surface. A regulating member regulates the amount of developer deposited on the developer carrier. A developer storing space stores a part of the developer removed by the regulating member. A toner storing space adjoins the developer storing space at the upstream side with respect to a direction in which the developer carrier conveys the developer, and formed with a toner replenishing opening facing the developer carrier. The developer consists of a first developer containing first magnetic particles, and mainly deposited in a layer on the surface of the developer carrier, and a second developer containing second magnetic particles different from the first magnetic particles, and stored in the developer storing space in such a manner as to contact the first developer over a range from the toner replenishing opening to the regulating member. The first magnetic particles have a higher charging ability than the second magnetic particles.

Also, in accordance with the present invention, a developing device has a developer carrier for conveying a developer deposited on the surface and consisting of toner and magnetic particles. A toner storing space stores toner therein and has an opening facing the surface of the developer carrier. A developer holding space holds a developer therein and has an opening facing the surface of the developer carrier.

Further, in accordance with the present invention, a toner cartridge has a hollow cylindrical container storing toner therein, an outlet formed in the circumferential wall of the container, and for causing the toner to be discharged therethrough, a lid pivotally mounted on the circumferential wall of the container, and for selectively opening or closing the outlet, a first magnetic member fitted on the container and adjoining the outlet, and a second magnetic member fitted on the free edge portion of the lid. The lid hermetically closes the outlet due to attraction acting between the first magnetic member and the second magnetic member.

Moreover, in accordance with the present invention, in an image forming apparatus for forming a toner image by feeding toner from a toner cartridge mounted to a developing device to a latent image electrostatically formed on an image carrier, the toner cartridge has a hollow cylindrical container storing toner therein, an outlet formed in the circumferential wall of the container, and for causing the toner to be discharged therethrough, a lid pivotally mounted on the circumferential wall of the container, and for selectively opening or closing the outlet, a first magnetic member fitted on the container and adjoining the outlet, and a second magnetic member fitted on the free edge portion of the lid. The lid hermetically closes the outlet due to attraction acting between the first magnetic member and the second magnetic member. The developing device has a mount portion for mounting the container in a rotatable manner, a toner replenishing opening formed in the mount portion and facing the outlet of the container, and a portion for selectively opening or closing the lid when the container is rotated about its own axis.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENTS

Figure 1:
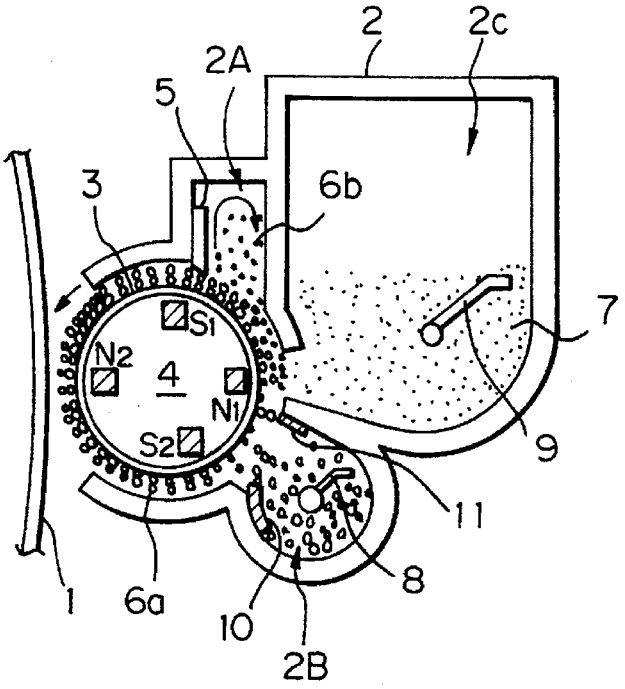
FIG. 1 is a section showing a developing device embodying the present invention.

Referring to FIG. 1 of the drawings, a developing device embodying the present invention is shown and applied to an electrophotographic copier by way of example. As shown, the developing device has a casing 2 adjoining a photoconductive drum 1 and formed with an opening facing the drum 1. A developing sleeve, or developer carrier, 3 is disposed in the casing 2 and partly exposed to the outside through the opening of the casing 2. A first developer *6a* is deposited on the sleeve 3 and mainly consists of toner and first magnetic particles which will be referred to as a first carrier hereinafter. A magnet roller, or magnetic field generating means, 4 is fixed in place within the sleeve 3 and has a plurality of fixed magnets. A doctor, or regulating member, 5 regulates the amount of the developer deposited on the sleeve 3.

The inner periphery of the casing 2 is so configured as to define three sections or spaces 2A, 2B and 2C. The space 2A accommodates a second developer *6b* mainly consisting of toner and second magnetic particles which are shaved off by the doctor 5. The second magnetic particles will be referred to as a second carrier hereinafter. The space 2B stores the first developer *6a*. The space 2C stores fresh toner 7 to be replenished into the developer deposited on the sleeve 3. Most preferably, the gap between the wall isolating the spaces 2A and 2C and the surface of the sleeve 3 is about 0.3 mm to about 2.0 mm. Should this gap be excessively small, the developer would form blocks to thereby increase the torque necessary for the rotation of the sleeve 3. Should it be excessively great, the frictional charging of the toner would be deficient to thereby cause the background of an image to be smeared and cause the toner to fly about.

The sleeve 3 is implemented as a hollow cylinder formed of a nonmagnetic material. The sleeve 3 is freely rotatably supported at opposite ends thereof by shafts, not shown, which are parallel to the axis of the drum 1. A drive section, not shown, rotates the sleeve 3 in a direction indicated by an arrow in FIG. 1. The sleeve 3 may be replaced with an endless belt passed over a plurality of rollers, if desired.

The magnet roller 4 is disposed in the sleeve 3 and held stationary even when the sleeve 3 is rotated. The surface of the roller 4 facing the sleeve 3 is constituted by four magnets N1, N2, S1 and S2. The magnet N1, magnetized to the N pole, conveys the first developer 6*a* to a toner replenishing position and further conveys it to the space 2A together with the second developer 6*b*. In addition, the magnet N1 forms a magnetic field for cause the developer to stand at the end of the space 2B adjoining the space 2C, as will be described specifically later. The magnet S1, magnetized to the S pole, conveys the first developer 6*a* to a regulating position assigned to the doctor 5, and further conveys the developer caused to form a layer by the doctor 5 to a developing region where the sleeve 3 faces the drum 1. The magnet N2, magnetized to the N pole, conveys the first developer 6*a* in the developing region. The magnet S2, magnetized to the S pole, conveys the first developer 6, moved away from the developing region, to the opening of the space 2B and toner replenishing position. The N and S poles of the roller 4 mentioned above may be replaced with each other. Further, the four magnets may be replaced with a single magnetic body magnetized to the N and S poles.

Agitators 8 and 9 are respectively disposed in the spaces 2B and 2C and agitate the developer and toner accommodated therein. The space 2B us used to temporarily hold the first developer 6*a* therein. A magnet or magnetic body 10 is affixed to a portion of the wall of the space 2B defining the opening and leading the other portion with respect to the direction of rotation of the sleeve 3. The opening of the space 2B is positioned below the surface of the sleeve 3 while the magnet 10 is positioned several millimetes below the opening of the space 2B. In this configuration, the developer carried on the sleeve 3 is easily taken into the space 2B by gravity and the magnetic force of the magnet 10. In order to more surely take the developer into the space 2B, it is preferable that the magnetic force of the magnet 10 be more intense than that of the sleeve 3. If the opening of the space 2B is excessively small, the gap between the magnet 10 and a magnetic body 11, which will be described, will be too small to cause the developer to drop into the space 2B. Hence, the opening should be so sized as to allow the developer to drop into the space 2B.

The agitator 8 in the space 2B is so dimensioned as to contact the magnet 10. The agitator 8, therefore, serves to scrape off the developer deposited on the magnet 10. The developer scraped off by the agitator 8 is mixed with the developer held in the space 2B and then deposited on the sleeve 3 as a uniform mixture.

The magnetic body 11 is located at the other end of the opening of the space 2B. While the magnet N1 of the sleeve 3 forms an electric field, the body 11 causes the field to concentrate on the boundary between the adjoining spaces 2B and 2C and thereby causes the developer to stand, i.e., forms a developer standing portion. This portion prevents the toner from dropping from the space 2C into the space 2B and makes it difficult for the developer in the space 2B to enter the space 2C.

In order to insure the developer standing portion, the magnet N1 of the sleeve 3 should preferably be closer to the space 2B than to the center of the opening of the space 2C. From the cost standpoint, it is preferable to implement the magnetic body 11 with an about 1.0 mm thick flat sheet made of, e.g., secc-c 20/20 (steel sheet plated with electrolytic zinc as prescribed by Japanese Industrial Standards) or similar iron. When the magnetic body 11 is implemented by a magnetized body (magnet), it should preferably be magnetized to a degree which obviates the excessive blocking of the developer and toner and allows them to be easily conveyed by the sleeve 3. The magnet 10 and magnetic body 11 are shown as adjoining the opening of the space 2B. Alternatively, the inner periphery of the space 2B or the agitator 8 may be implemented as a magnetic body.

Figure 2:
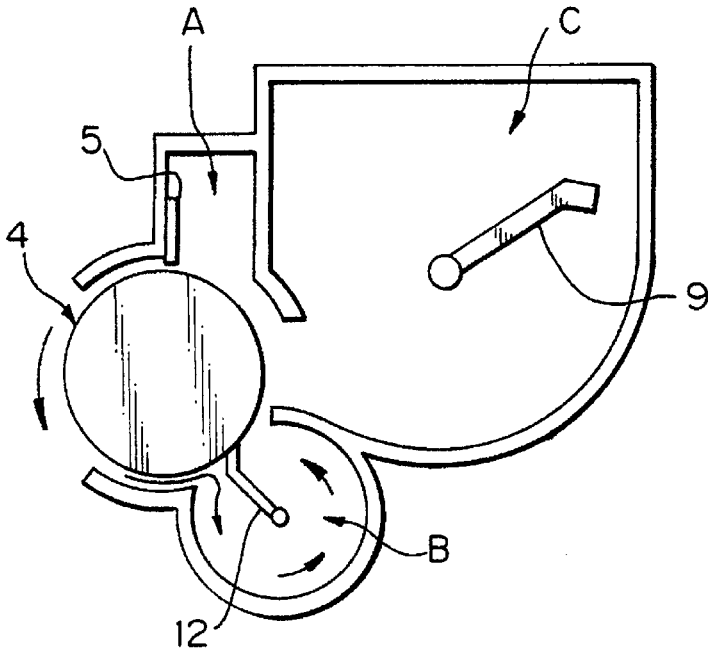
FIG. 2 is a section showing a modification of the embodiment.

In FIG. 1, the magnetic force of the magnet 10 is used to remove the developer from the sleeve 3 and introduce it into the space 2B. Alternatively, as shown in FIG. 2, use may be made of a scraper 12 contacting the surface of the sleeve 3 at its free edge and playing the role of an agitator at the same time. The scraper 12 in rotation forcibly scrapes off the developer of the sleeve 3 into the space 2B. Further, in FIG. 1, the agitator 8 conveys the developer in the space 2B toward the sleeve 3 while circulating it. However, the agitator 8 is omissible if a certain amount of developer is held in the space 2B and naturally returned to the sleeve 3 by the force of the magnet roller 4.

The fresh toner stored in the space 2C is fed to the toner replenishing position, as needed. Specifically, the agitator 9 is rotated to convey the toner to the toner replenishing position where the second developer 6*b* on the sleeve 3 is exposed. As a result, the fresh toner is replenished into the first developer 6*a* and second developer 6*b* carried on the sleeve 3.

In operation, the doctor 5 mainly regulates the amount of the first developer 6*a* deposited in a layer on the sleeve 3 which is in rotation. The toner layer is conveyed to the developing position and develops a latent image electrostatically formed on the drum 1. The second developer 6*b* shaved off by the doctor 5 moves toward the toner replenishing opening at a position spaced from the surface of the sleeve 3 due to its own internal pressure and weight. The volume of the second developer 6*b* changes with a change in the toner concentration of the developer. When the toner concentration is high, the area over which the developer 6*a* on the sleeve 3, which is to be conveyed to the developing region in a great ratio, contacts the fresh toner in the space 2C decreases, thereby reducing the amount of toner to be replenished into the developer 6*a*. When the toner concentration is low, the above-mentioned area and, therefore, the amount of toner to be replenished into the developer 6*a* increases. In this manner, the amount of toner replenishment into the developer 6*a* changes with a change in the toner concentration, so that the toner concentration of the developer 6*a* is held in a predetermined range. The embodiment is, therefore, capable of automatically controlling the toner concentration of the developer without resorting to a toner replenishing mechanism or a toner concentration sensor.

The toner introduced into the developer 6*a* is conveyed to the developing region via the doctor 5 while being charged by friction acting between it and the carrier. On the other hand, the second developer 6*b* rotates in the space 2A. This also causes the toner to be charged by friction acting between it and the carrier. At this instant, the carrier of the first developer 6*a* has a higher charging ability than the carrier of the second developer 6*b*. Hence, the electrostatic attraction acting between the carrier and the toner of the first developer 6*a* is more intense than the attraction acting between the carrier and the toner of the second developer 6*b*. This allows the sufficiently charged toner of the second developer 6*b* to be efficiently moved into the first developer 6*a* carried on the sleeve 3. In this way, the embodiment is capable of introducing sufficiently charged toner into the first developer 6*a*, which contributes to development, although the toner is sequentially consumed.

Even in an arrangement wherein the developer on the sleeve 3 and the developer in the space 2B are replaced with each other in order to deposit a small amount of developer on the sleeve 3, the developer mainly deposited on the sleeve 3 suffers from a minimum of damage and has its life extended. This is particularly desirable with high-speed machines. The minimization of damage is also achievable even when a single kind of developer is used or when a relatively small amount of developer is deposited on the sleeve.

The toner and carrier for use with the above developing device will be described hereinafter.

Toner produced by any of conventional methods is applicable to the developing device. For example, the toner may be produced by melting and kneading a mixture of a binder resin, coloring agent and polarity control agent, solidifying the mixture by cooling, and then pulverizing and classifying it. The toner may contain any desired additive in addition to the above three ingredients.

For the binder resin, any conventional substance is usable. For example, the resin may be implemented by a polymer of polystyrene, poly-p-styrene, polyviny toluene or similar styrene and its substituent; styrene-p-chlorostyrene copolymer, styrene-polypropylene copolymer, styrene-vinyl toluene copolymer, styrene-methyl acrylate copolymer, styrene-ethyl acrylate copolymer, styrene-butyl acrylate copolymer, styrene-methyl methacrylate copolymer, styrene-ethyl methacrylate copolymer, ethyrene-butyl methacrylate copolymer, styrene-α-methyl chloromethacryalte copolymer, styrene-acryloniotrile copolymer, styrene-vinyl methyl ether copolymer, styrene-vinyl methyl ketone copolymer, styrene-butadiene copolymer, styrene-isoprene copolymer, styrene-maleic acid copolymer, styrene-maleic acid ester, or similar styrene copolymer; or polymethyl methacrylate, polybutyl methacrylate, polyvinyl chloride, polyvinyl acetate, polyethyrene, polypropyrene, polyester, polyurethane, polyamide, epoxy resin, polyvinyl butyral, polyacrylic acid resin, resin, rosin, denaturated rosin, terpen resin, phenol resin, aliphatic or aliphatic hydrocarbon resin, aromatic oil resin, paraffin chloride, or paraffin wax either singly or in combination. Particularly, when plyester resin is used, there can be obtained a developer resistive to binding to a vinyl chloride mat and preserving the original color.

The polarity control agent may also be implemented by any one of conventional substances including metal complexes of monoazo dyes, nitrohumic acid and its salts, Co, Cr, Fe and other metal complex amino compounds of salicylic acid, naphthoic acid, and dicarboxylic acid, quaternary ammonium compounds, and organic dyes. The polarity control agent is used in an amount depending on whether or not an additive or addives are present, and on the production method including a dispersion method. Preferably, 0.1 to 20s part by weight of polarity control agent is used for 100 parts by weight of binder resin. Contents smaller than 0.1 part by weight are not practical because the resulting amounts of charge are short. Contents greater than 20 parts by weight deposit excessive amounts of charge on the toner; the attraction between the toner and the carrier lowers the fluidity of the developer and the image quality.

The coloring agents include black agents, cyan agents, magenta agents, and yellow agents. The black agents include carbon black, Aniline Black, furnace black, and lamp black. The cyan agents include Phthalocyanine Blue, Ethylene Blue, Methylene Blue, Victoria Blue, Methyl Violet, Aniline Blue, and ultramarine blue. The magenta agents include Rhodamine 6G Lake, dimethyl quinacridone, Wathcing Red, Rose Bengale, Rhodamine B, and Alizarin Lake. The yellow agents include chrome yellow, Benzidine Yellow, Hansa Yellow, Molybdenum Orange, Quinoline Yellow, and Tartrazine.

A magnetic substance may be contained in the toner to provide it with magnetic property. The magnetic substance may be selected from a group of metals including magnetite, hematite, ferrite and other iron oxides, iron, cobalt, arid nickel; and alloys of such metals with aluminum, cobalt, copper, lead, magnesium, tin, zinc, antimony, berillium, bismuth, cadmium, calcium, manganese, selenium, titanium, tungsten, and vanadium, and their mixtures. These ferromagnetic substances should preferably have a mean particle size of about 0.1 μm to about 2 μm; in the toner, they each should have a content of about 20 parts by weight for 100 parts by weight of resin, preferably 40 parts by weight to 150 parts by weight for 100 parts by weight of resin.

Additives which may be added to the toner include Teflon, zinc stearate and other lubricants, selium oxide, zirconium oxide, silicon, titanium oxide, aluminum oxide, silicon carbonate and other abrasives, coloidal silica, aluminum oxide and other fluidity agents, anti-caking agents, carbon black, and tin oxide and other conduction agents, polyolefin of low moledular weight and other fixation promoting agents. Among the fluidity agents, coloidal silica is preferable. Among the abrasives which grind the surfaces of the carrier, aluminum oxide and silicon carbonate are desirable.

An abrasive may be contained in the fresh toner in the space 2C as an additive. The abrasive should have a hardness lower than that of the carrier of the first developer *6a*, but higher than that of the carrier of the second developer *6b*. The abrasive in the toner grinds the surface of the carrier of the first developer which contributes to development in the developing region. This frees the carrier from the previously mentioned spending and allows it to be repeatedly used over a long period of time. The abrasive may be contained in the second developer *6b* in place of the first developer *6a*, if desired.

The carrier deposits an amount of charge lying in the range of 10 μC/g to 50 μC/g in absolute value. The carrier of the first developer *6a* has a higher charging ability than the carrier of the second developer *6b*, so that the toner particles introduced into the second developer can efficiently migrate into the first developer *6a*. Particularly, the charging ability of the carrier of the first developer *6a* and that of the carrier of the second developer *6b* should preferably have a charging ability of 20 μC/g to 50 μC/g and a charging ability of 10 μC/g to 30 μC/g, respectively. This successfully facilitates the migration of the toner to the first developer *6a*.

The carriers each has a volume resistivity ranging from $10^8$ Ωcm to $10^{16}$ Ωcm. The carrier of the first developer *6a* has a higher volume resistance than the carrier of the second developer *6b*. This reduces the resistance of the developer in the developing region and thereby guarantees desirable solid images without an edge effect. Preferably, the carriers of the first and second developers *6a* and *6b* respectively have volume resistivities of $10^8$ Ωcm to $10^{13}$ Ωcm $10^{13}$ Ωcm to $10^{16}$ Ωcm.

In a magnetic field of $7.9\times10^3$ A/m, the carriers each has a saturation magnetization lying in the range of 1,000 G to 6,000 G. The carrier of the first developer *6a* has a higher saturation magnetization than the carrier of the second developer *6b*, so that the force restraining the developer on the developing sleeve is intensified in the developing region. This effectively obviates the transfer of the carrier to the drum and thereby insures attractive images. Particularly, it is preferable that the carriers of the first and second developer *6a* and *6b* respectively have saturation magnetisms of 4,000 G to 6,000 G and 1,000 G to 5,000 G.

The carriers each has a weight mean particle size of 10 μm to 500 μm. The carrier of the first developer *6a* has a smaller weight mean particle size than the carrier of the second developer 6b. This increases the toner concentration of the first developer 6a in the developing region and thereby insures high image density even under developing conditions particular to high-speed machines. Particularly, it is preferable that the carriers of the first and second developers 6a and 6b respectively have weight mean particle sizes of 30 μm to 70 μm and 50 μm to 120 μm.

The cores of the carriers may be implemented by, e.g., iron, cobalt, nickel or similar ferromagnetic metal, magnetite, hematite, ferrite or similar alloy or compound, or a compound thereof.

The surfaces of the carrier particles should preferably be covered with a resin in order to enhance durability. Resins usable for this purpose include polyethylene, polypropyrene, chlorinated polyethylene, chlorosulfonated polyethylene, and other polyorefin resins; polystyrene, acryl (e.g. polymethyl methacrylate), polyacrylonitrile, polyvinl acetate, polyvinyl alcohol, polyvinyl butyral, polyvinyl chloride, polyvinyl carbazole, polyvinyl ether, polyvinyl ketone, and other polyvinylidene resins; vinyl chloride-vinyl acetate copolymer; styrene-acrylic acid copolymer; silicone resin having an organosilixane coupling, and its denaturated substances (e.g. derived from alkyd resin, polyester resin, epoxy resin, and polyurethan); polytetrafluoroethylene, polyvinyl fluoride, polyvinylidene fluoride, polychlorotrifuoroethylene, and other flurine-containted resins; polyamide; polyester; polyurethane, polycarbonate; urea-formardehyde resin and other amino resins, and epoxy resins. Among them, silicone resin and its denaturated substances and fluorine-contained resin, particularly silicone resin and its denatuated substances, are desirable.

The silicone resin may be selected from a group of conventional silicone resins. Typical of the silicone resins are straight silicone having only an organosiloxane coupling, and silicone resin denaturated by alkyd, polyester, epoxy, urethane or the like, as represented by the following formula:

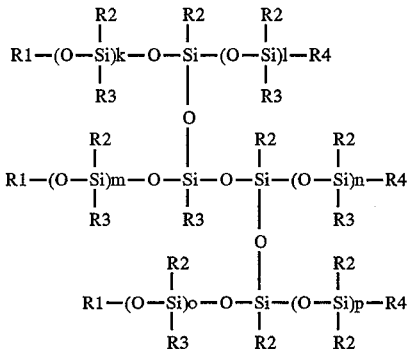

(1)

where R1 is a hydroxyl group, or alkyl group or phenyl group having one to four carbon atoms, and R2 and R3 are hydrogen groups, or alkoxy groups, phenyl groups or phenoxy groups having one to four carbon atoms, or alkenyloxy groups, hydroxy groups, carboxyl groups, ethyleneoxid groups or glycidyl groups having two to four carbon atoms, or groups expressed by the following formula:

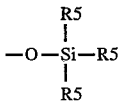

(2)

where R4 and R5 are hydroxy groups, carboxyl groups, alkyl groups having one to four carbon atoms, alkoxyl groups having one to four carbon atoms, alkenyl groups having two to four carbon atoms, alkenyloxy groups having two to four carbon atoms, phenyl groups, or phenoxy groups, and k, l, m, n, o and p are positive integers greater than 1, inclusive of 1.

The above substituents may have, e.g., amino acid, hydroxy groups, carboxyl groups, mercapto groups, alkyl groups, phenyl groups, ethylene oxide groups, glycidyl groups, and halogen atoms.

A conduction agent may be contained in the layer covering the carrier in order to control its volume resistivity. The conduction agent may be implemented by any conventional substances including, iron, gold, copper and other metals, oxides of ferrite and magnetite, and carbon black and other pigments. Among them, when use is made of a mixture of furnace black and acetylene black which belong to a family of carbon blacks, it is possible to effectively control the conductivity with a small amount of conductive powder and, in addition, to produce a carrier covered with a layer which is highly wear-resistant. Preferably, the conductive particle should have a particle size of about 0.01 μm to about 10 μm and should be added in an amount of 2 parts by weight to 30 parts by weigh, more preferably 5 parts by weight to 20 parts by weight, for 100 parts by weight of covering resin.

Further, the layer covering the carrier may contain a cylane coupling agent, titanium coupling agent or similar coupling agent in order to enhance the bond thereof with the particles as well as the dispersion of the conduction agent. The cylane coupling agent is a compound expressed by a general formula:

$$YRSiX_3 \quad (3)$$

where X is a hydrolysis group, e.g., a chloro group, alcoxy group, acetoxy group, alkylamino group, or propenoxy group, Y is an organic functional group reactive to an organic matrix, e.g., a vinyl group, methacryl group, epoxy group, glycidexy group, amino group, or mercapto group, and R an alkyl group or an alkylene group having one to twenty carbons.

Among the cylane coupling agents, one having an amino group in Y is preferable when a developer chargeable to the negative polarity is desired. The epoxy cylane coupling agent having an epoxy group in Y is preferable when a developer chargeable to the positive polarity is desired.

The layer covering the carrier may be formed by applying a coating liquid to the surfaces of core particles by spraying, immersion or similar technology. The layer should preferably be 1 μm thick to 20 μm thick.

The carrier and toner should preferably be mixed such that the toner particles deposit on the surfaces of the carrier particles and occupy 30% to 90% of the areas of the surfaces. An abrasive may be contained in the developer so as to remove the spent toner films from the carrier particles by grinding.

Practical examples of the toner and carrier applicable to the apparatus shown in FIG. 1, and the results of experiments conducted with their combinations, or developers, will be described hereinafter.

[Toner 1]

A mixture having a composition listed in Table 1 below was melted and kneaded by a heat roll of 120° C., cooled to solidify, pulverized by a jet mill, and then classified to produce toner particles a having a mean particle size of 10 μm.

TABLE 1

| | |
|---|---|
| styrene-acryl resin (Himer 75 available from Sanyo Kagaku) | 93 parts by weight |
| carbon black (#44 available from Mitsubishi Kasei) | 5 parts by weight |
| quaternary ammonium salt compound (Bontron P-51 available from Orient Kagaku) | 2 parts by weight |

[Toner 2]

The procedure for Toner 1 was repeated except for the use of a mixture shown in Table 2 below, thereby producing core particles.

TABLE 2

| | |
|---|---|
| polyester resin (Mw = 55,000; tg = 62° C.) | 93 parts by weight |
| carbon black (#44 available from Mitsubishi Kaset) | 5 parts by weight |
| quaternary ammonium salt compound (Bontron P-51 available from Orient Kagaku) | 2 parts by weight |

In Table 2, Mw and Tg are representative of the weight mean molecular weight and glass transition temperature, respectively.

99.5 parts by weight of the particles and fine silica powder (R-972 available from Nihon Aerogil) were mixed by a mixer to produce toner particles b.

[Carrier 1]

100 parts by weight of magnetite produced by a wet process, 2 parts by weight of polyvinyl alcohol, and 60 parts by weight of water were mixed by a ball bill for 12 hours to prepare a magnetite slurry. The slurry was sprayed by a spray drier to produce spherical particles having a mean particle size of 52 μm. The particles were baked at 1,000° C. for 3 hours in a nitrogen atmosphere and then cooled to obtain core particles 1. A mixture having a composition listed in Table 3 below was dispersed for 20 minutes by a homomixer to prepare a coating liquid 1.

TABLE 3

| | |
|---|---|
| silicone resin solution (SR-2410 available from Toray Dow Corning Silicone) | 100 parts by weight |
| toluene | 100 parts by weight |
| methyltrietoxysilane | 6 parts by weight |
| carbon black (#44 available from Mitsubishi Kasei; BET surface area = of $m^2/g$) | 10 parts by weight |

The coating liquid 1 was coated on the surfaces of 1,000 parts by weight of core particles 1 by use of a fluidized bed type coating device, thereby producing a carrier A coated with a silicone resin. The carrier A had a mean particle size of 54 μm, a volume resistivity of $4.3\times10^{11}$ Ωcm, and a saturation magnetization of 5,650 G.

[Carrier 2]

A mixture listed in Table 4 below was melted, kneaded, pulverized, and then classified to produce core particles 2 having a mean particle size of 80 μm.

TABLE 4

| | |
|---|---|
| polyester (condensation product consisting of ethylene oxide addition type bisphenol A and terephthalic acid) | 30 parts by weight |

TABLE 4-continued

| | |
|---|---|
| fine magnetite particles (mean particle size of 0.8 μm; saturation magnetization of 6,840 G) | 70 parts by weight |

A mixture shown in Table 5 was dispersed for 20 minutes by a homomixer to produce a coating liquid 2.

TABLE 5

| | |
|---|---|
| silicone resin solution (SR-2410 available from Toray Dow Corning Silicone) | 100 parts by weight |
| toluene | 100 parts by weight |

The liquid 2 was coated on the surfaces of 600 parts by weight of core particles 2 by use of a fluidized bed type coating device, thereby producing a carrier B coated with a silicone resin. The carrier B had a mean particle size of 83 μm, a volume resistivity of $8.7\times10^{15}$ Ωcm, and a saturation magnetization of 4,780 G.

[Carrier 3]

100 parts by weight of magnetite produced by a wet process, 2 parts by weight of polyvinyl alcohol and 60 parts by weight of water were mixed for 12 hours by a ball mill to prepare a magnetite slurry. The slurry was sprayed by a spray drier to form spherical particles having a mean particle size of 30 μm. The particles were baked at 1,000° C. for 3 hours in a nitrogen atmosphere, and then cooled to produce core particles 3. A mixture shown in Table 6 below was dispersed for 20 minutes by a homomixer to prepare a coating liquid 3.

TABLE 6

| | |
|---|---|
| silicone resin solution (SR-2410 available from Toray Dow Corning Silicone | 100 parts by weight |
| toluene | 100 parts by weight |
| γ-chloropropyl trimethoxysilane | 15 parts by weight |
| carbon black (#44 available from Mitsubishi Kasei; BET surface area of 125 $m^2/g$) | 20 parts by weight |

The liquid 3 was coated on the surfaces of 1,000 parts by weight of core particles 3 by use of a fluidized bed type coating device, thereby producing a carrier C coated with a silicone resin. The carrier C had a mean particle size of 34 μm, a volume resistivity of $3.7\times10^{8}$ Ωcm, and a saturation magnetization of 5,540 G.

[Carrier 4]

A mixture shown in Table 7 below was melted, kneaded, pulverized and then classified to produce core particles 4 having a mean particle size of 70 μm.

TABLE 7

| | |
|---|---|
| polyester (condensation product consisting of ethylene oxide addition type bisphenol A and terephthalic acid) | 50 parts by weight |
| fine magnetite particles (mean particle size of 0.8 μm; saturation magnetization of 6,840 G) | 50 parts by weight |

A mixture shown in Table 8 below was dispersed for 20 minutes by a homomixer to prepare a coating liquid 4.

TABLE 8

| | |
|---|---|
| silicone resin solution (SR-2410 available from Toray Dow Corning Silicone) | 100 parts by weight |
| toluene | 100 parts by weight |
| γ-chloropropyl trimethoxysilane | 3 parts by weight |
| carbon black (#44 available from Mitsubishi Kasei; BET surface area of 125 $m^2/g$) | 3 parts by weight |

The liquid 4 was coated on the surfaces of 400 parts by weight of core particles 4 by use of a fluidized bed type coating device, thereby producing a carrier D coated with a silicone resin. The carrier D had a mean particle size of 71 μm, a volume resistivity of $4.1\times10^{14}$ Ωcm, and a saturation magnetization of 3,420 G.

[Carrier 5]

A mixture shown in Table 9 was dispersed for 20 minutes by a homomixer to prepare a coating liquid 5.

TABLE 9

| | |
|---|---|
| silicone resin solution (SR-2410 available from Toray Dow Corning Silicone) | 100 parts by weight |
| toluene | 100 parts by weight |
| γ-chloropropyl trimethoxysilane | 3 parts by weight |
| carbon black (#44 available from Mitsubishi Kasei; BET surface area of 125 $m^2/g$) | 3 parts by weight |

The liquid 5 was coated on the surfaces of 1,000 parts by weight of core particles 1 of Carrier 1, thereby producing a carrier E coated with a silicone resin. The carrier E had a mean particle size of 53 μm, a volume resistivity of $2.7\times10^{11}$ Ωcm, and a saturation magnetization of 5,610 G.

[Carrier 6]

A mixture shown in Table 10 below was melted, kneaded, pulverized, and then classified to prepare core particles 5 having a mean particle size of 49 μm.

TABLE 10

| | |
|---|---|
| polyester (condensation product consisting of ethylene oxide addition type bisphenol A and terephthalic acid) | 50 parts by weight |
| fine magnetite particles (mean particle size of 0.8 μm; saturation magnetization of 6,840 G) | 50 parts by weight |

A mixture shown in Table 11 was dispersed for 20 minutes by a homomixer to prepare a coating liquid 6.

TABLE 11

| | |
|---|---|
| silicone resin solution (SR-2410 available from Toray Dow Corning Silicone) | 100 parts by weight |
| toluene | 100 parts by weight |
| γ-chloropropyl trimethoxysilane | 15 parts by weight |
| carbon black (#44 available from Mitsubishi Kasei) | 7 parts by weight |

The liquid 6 was coated on the surfaces of 400 parts by weight of the particles 5 by use of a fluidized bed type coating device, thereby producing a carrier F coated with a silicone resin. The carrier F had a mean particle size of 53 μm, a volume resistivity of $5.1\times10^{10}$ Ωcm, and a saturation magnetization of 4,320 G.

[Carrier 7]

A mixture shown in Table 12 below was dispersed for 20 minutes by a homomixer to prepare a coating liquid 7.

TABLE 12

| | |
|---|---|
| silicone resin solution (SR-2410 available from Toray Dow Corning Silicone) | 100 parts by weight |
| toluene | 100 parts by weight |

The liquid 7 was coated on the surfaces of 1,000 parts by weight of core particles 1 of Carrier 1, thereby producing a carrier G coated with a silicone resin. The carrier G had a mean particle size of 72 μm, a volume resistivity of $4.9\times10^{11}$ Ωcm, and a saturation magnetization of 5,420 G.

[Carrier 8]

100 parts by weight of magnetite produced by a wet process, 2 parts by weight of polyvinyl alcohol, and 60 parts by weight of water were mixed for 12 hours by a ball mill to prepare a slurry of magnetite. The slurry was sprayed by a spray drier to produce spherical particles having a mean particle size of 69 μm. The particles were baked at 1,000° C. for 3 hours in a nitrogen atmosphere, and the cooled to turn out core particles 6. The liquid 1 produced for Carrier 1 was also coated on the surfaces of 1,000 parts by weight of particles 6 by use of a fluidized bed type coating device, thereby producing a carrier H coated with a silicone resin. The carrier H had a mean particle size of 72 μm, a volume resistivity of $4.9\times10^{11}$ Ωcm, and a saturation magnetization of 5,420 G.

[Carrier 9]

A mixture shown in Table 13 below was melted, kneaded, pulverized, and then classified to produce core particles 7 having a mean particle size of 55 μm.

TABLE 13

| | |
|---|---|
| polyester (condensation product consisting of ethylene oxide addition type bisphenol A and terephthalic acid) | 10 parts by weight |
| fine magnetite particles (mean particle size of 0.8 μm; saturation magnetization of 6,840 G) | 90 parts by weight |

A mixture shown in Table 14 below was dispersed for 20 hours by a homomixer to prepare a coating liquid 8.

TABLE 14

| | |
|---|---|
| silicone resin solution (SR-2410 available from Toray Dow Corning Silicone) | 100 parts by weight |
| toluene | 100 parts by weight |

The liquid 8 was coated on the surfaces of 800 parts by weight of particles 7 by use of a fluidized bed type coating device, thereby producing a carrier I coated with a silicone resin. The carrier I had a mean particle size of 57 μm, a volume resistivity of $2.4\times10^{11}$ Ωcm, and a saturation magnetization of 5,210 G.

As shown in Table 15 below, in Examples 1–10 of the present invention, toners and carriers produced on the basis of the above Toners 1 and 2 and Carriers 1–9 were mixed in various ways to produce the first and second developers *6a* and *6b*. The developing device of FIG. 1 was built in a copier FT1520 (trade name) available from Ricoh Co., Ltd. and operated to output 50,000 images with each of the toner and carrier combinations. The toner and carrier combinations were evaluated as to background contamination, thin line reproducibility, presence/absence of carrier development, and spending.

TABLE 15

| | 1st Developer | | | | | | 2nd Developer | | | | | |
|---|---|---|---|---|---|---|---|---|---|---|---|---|
| | Toner | Carrier | Particle Size | Sat. Mag. | Vol. Res. | Charge | Toner | Carrier | Particle Size | Sat. Mag. | Vol. Res. | Charge |
| Ex. | | | | | | | | | | | | |
| 1 | a | A | 54 μm | 5650 G | $4.3 \times 10^{11}$ Ωcm | 38 μC/g | a | B | 83 μm | 4780 G | $8.7 \times 10^{15}$ Ωcm | 18 μCg |
| 2 | a | A | 54 | 5650 | $4.3 \times 10^{11}$ | 38 | a | D | 71 | 3420 | $4.1 \times 10^{14}$ | 22 |
| 3 | b | A | 54 | 5650 | $4.3 \times 10^{11}$ | 42 | b | B | 83 | 4780 | $8.7 \times 10^{15}$ | 20 |
| 4 | b | C | 34 | 5540 | $3.7 \times 10^{8}$ | 46 | b | B | 83 | 4780 | $8.7 \times 10^{15}$ | 20 |
| 5 | b | C | 34 | 5540 | $3.7 \times 10^{8}$ | 46 | b | D | 71 | 3420 | $4.1 \times 10^{14}$ | 23 |
| 6 | b | E | 53 | 5610 | $2.7 \times 10^{11}$ | 41 | b | B | 83 | 4780 | $8.7 \times 10^{15}$ | 20 |
| 7 | b | A | 54 | 5650 | $4.3 \times 10^{11}$ | 42 | b | F | 53 | 3420 | $5.1 \times 10^{16}$ | 28 |
| 8 | b | F | 53 | 3420 | $5.1 \times 10^{10}$ | 28 | b | B | 83 | 4780 | $8.7 \times 10^{15}$ | 20 |
| 9 | b | H | 72 | 5420 | $4.9 \times 10^{11}$ | 37 | b | F | 53 | 3420 | $5.1 \times 10^{15}$ | 28 |
| 10 | b | H | 72 | 5420 | $4.9 \times 10^{11}$ | 37 | b | D | 71 | 3420 | $4.1 \times 10^{15}$ | 23 |
| 11 | b | 1 | 57 | 5210 | $2.4 \times 10^{11}$ | 34 | b | B | 83 | 4780 | $8.7 \times 10^{15}$ | 20 |
| Comp. Ex. | | | | | | | | | | | | |
| 1 | a | A | 54 | 5650 | $4.3 \times 10^{11}$ | 38 | a | A | 54 | 5650 | $4.3 \times 10^{11}$ | 38 |
| 2 | b | F | 53 | 3420 | $5.1 \times 10^{1n}$ | 28 | b | G | 54 | 5650 | $7.7 \times 10^{15}$ | 45 |

In Table 15, the carriers are selected such that the first developer 6a has a smaller mean particle size and lower volume resistivity than the second developer 6b, and deposits a greater amount of charge (charging ability) than the second developer 6b. The saturation magnetization of the first developer is greater than that of the second developer 6b, except for Example 8. For example, in Example 1, 95 parts by weight of carrier A and 5 parts by weight of toner α were mixed by a ball mill to produce the first developer 6a, while 95 parts by weight of carrier B and 5 parts of toner α were mixed by a ball mill to produce the second developer 6b. The developers 6a and 6b of Example 1 were measured to deposit 38 μC/g of charge and 19 μC/g of charge, respectively.

Table 15 also shows Comparative Examples 1 and 2 each using the first and second developers 6a and 6b different in the combination of characteristics from Examples 1–10. Specifically, in Comparative Examples 1 and 2, the first developer 6a substantially the same mean particle size as the second developer 6b, and has a saturation magnetization, volume resistivity and amount of charge (charging ability) substantially equal to or smaller than those of the developer 6b.

Table 16 shows the results of evaluation of Examples 1–10 and Comparative Examples 1 and 2 as to the initial background contamination, thin line reproducibility, presence/absence of carrier development, and spent state after the production of 50,000 copies.

TABLE 16

| | Initial | | | | After 50,000 |
|---|---|---|---|---|---|
| | Back Cont. | Line Rep. | Carrier Dev. | Halftone Rep. | Copies Spend |
| Ex. | | | | | |
| 1 | very good | very good | very good | good | good |
| 2 | very good | very good | very good | good | good |
| 3 | very good | very good | very good | good | very good |
| 4 | very good | very good | very good | good | very good |
| 5 | very good | very good | very good | good | very good |
| 6 | very good | very good | very good | good | exellent |
| 7 | very good | very good | very good | good | very good |
| 8 | very good | very good | good | very good | very good |

TABLE 16-continued

| | Initial | | | | After 50,000 |
|---|---|---|---|---|---|
| | Back Cont. | Line Rep. | Carrier Dev. | Halftone Rep. | Copies Spend |
| 9 | good | good | very good | good | very good |
| 10 | good | good | very good | good | very good |
| 11 | very good | very good | very good | very good | very good |
| Comp. Ex. | | | | | |
| 1 | no good | very good | very good | good | good |
| 2 | no good | very good | good | good | very good |

As Table 16 indicates, all the Examples 1–10 of the present invention achieved good results or excellent results.

Figure 5:
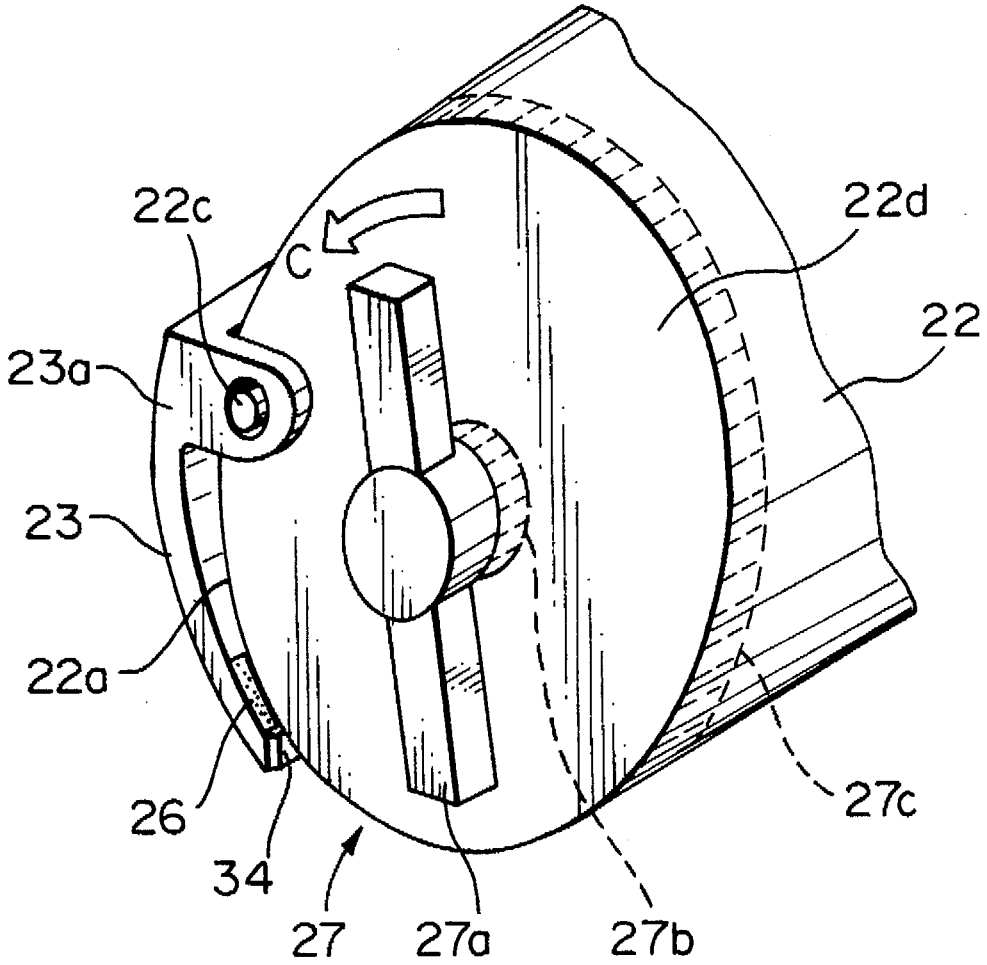
FIG. 5 is a fragmentary external view of the cartridge shown in FIG. 3.

Referring to FIG. 5, a toner cartridge embodying the present invention will be described and applied to a copier by way of example. As shown, the cartridge has a hollow cylindrical container 22 storing fresh toner 21 therein. An agitator 22e is disposed in the container 22. When the cartridge is mounted to a copier, the agitator 22e is rotated in a direction A by a drive mechanism built in the copier. An outlet 22b is formed through the cylindrical wall 22a of the container 22. The toner is driven out of the container 22 via the outlet 22b into a developing unit installed in the copier.

A lid 23 is mounted on the container 22 in order to cover and uncover the outlet 22b. Specifically, the lid 23 has ears 23a at opposite ends thereof while the container 22 has lugs 22c (only one is visible) at opposite ends 22d thereof. The ears 23a are respectively supported by the lugs 22c such that the lid 23 is freely rotatable about the lugs 22c. In the condition shown in FIG. 3, the lid 23 closes the outlet 22b. When the lid 23 is rotated in a direction B, it opens the outlet 22b.

A magnetic member 24 is affixed to one edge of the outlet 22b while a magnetic member 25 is affixed to one edge of the lid 23 corresponding to the edge of the outlet 22b. At least one of the magnetic members 24 and 25 is implemented by a magnet. When the lid 23 closes the outlet 22b, it surely adheres to the wall of the container 22 due to the magnetic force acting between the magnetic members 24 and 25, thereby surely closing the outlet 22b.

Figure 3:
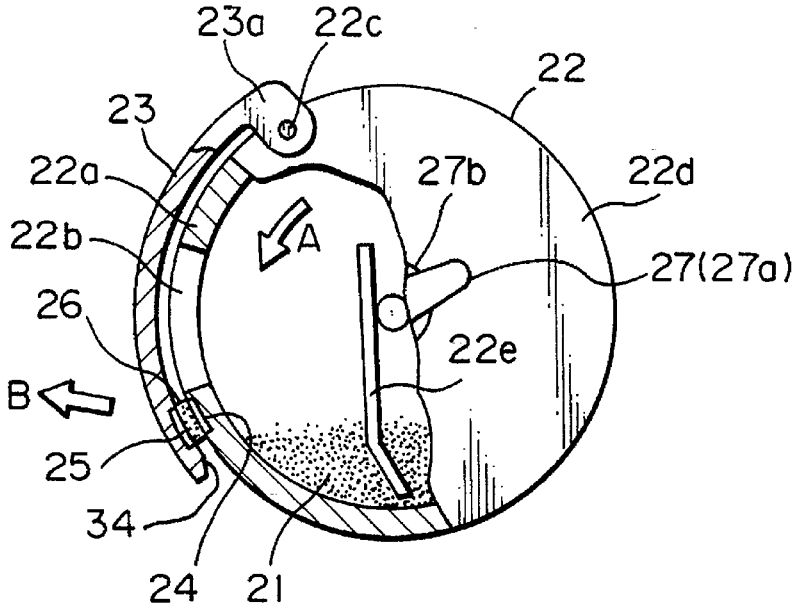
FIG. 3 is a section of a toner cartridge also embodying the present invention.
Figure 4:
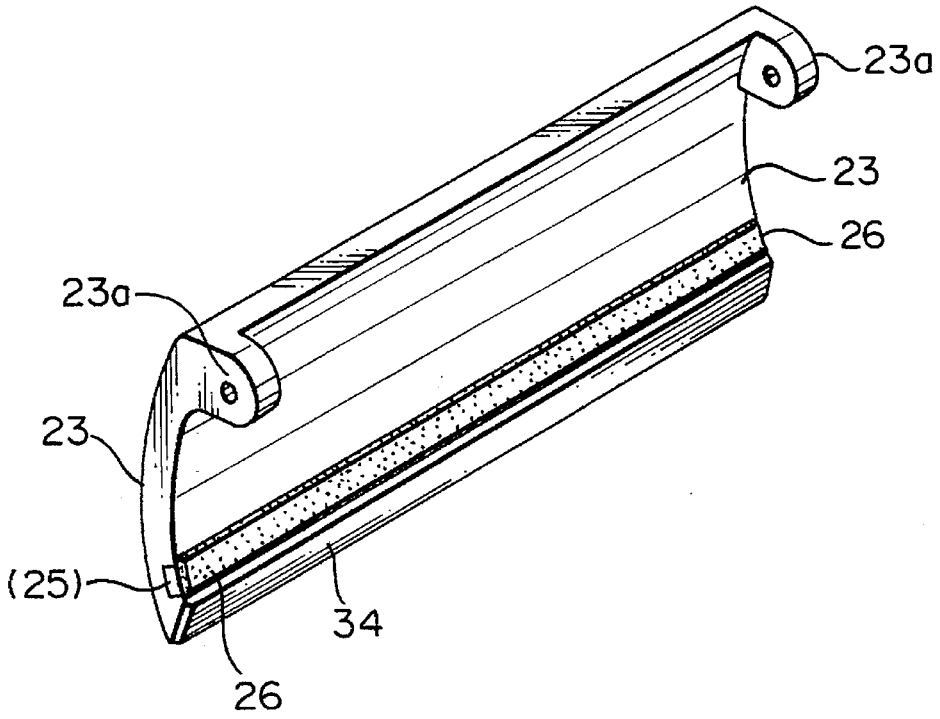
FIG. 4 is a perspective view of a lid included in the cartridge of FIG. 3.

As shown in FIG. 4, a strip of sponge 26 is adhered to the inner periphery of the lid 23 over the entire length of the lid 23, overlying the magnetic member 25. The sponge 26 hermetically seals the container 22 when the magnetic members 24 and 25 attract each other. Hence, even when the lid 23 is deformed, it closely contacts the container 22, as shown in FIG. 3. The toner 21 is, therefore, prevented from flowing out by accident.

Turning means 27 is provided on the front end 22*d* of the container 22, as seen when the cartridge is mounted to the copier. The turning means 27 has a knob 27*a*. As shown in FIG. 5, when the knob 27*a* is turned in a direction C by hand, the container 22 is rotated integrally with the knob 27*a*. The knob 27*a* may be replaced with a gear 27*b* mounted on the end 22*d* of the container 22 or a gear 27*c* formed on the outer periphery of the end 22*d*, in which case the gear 27*b* or 27*c* will be rotated by drive means, not shown.

Figure 6:
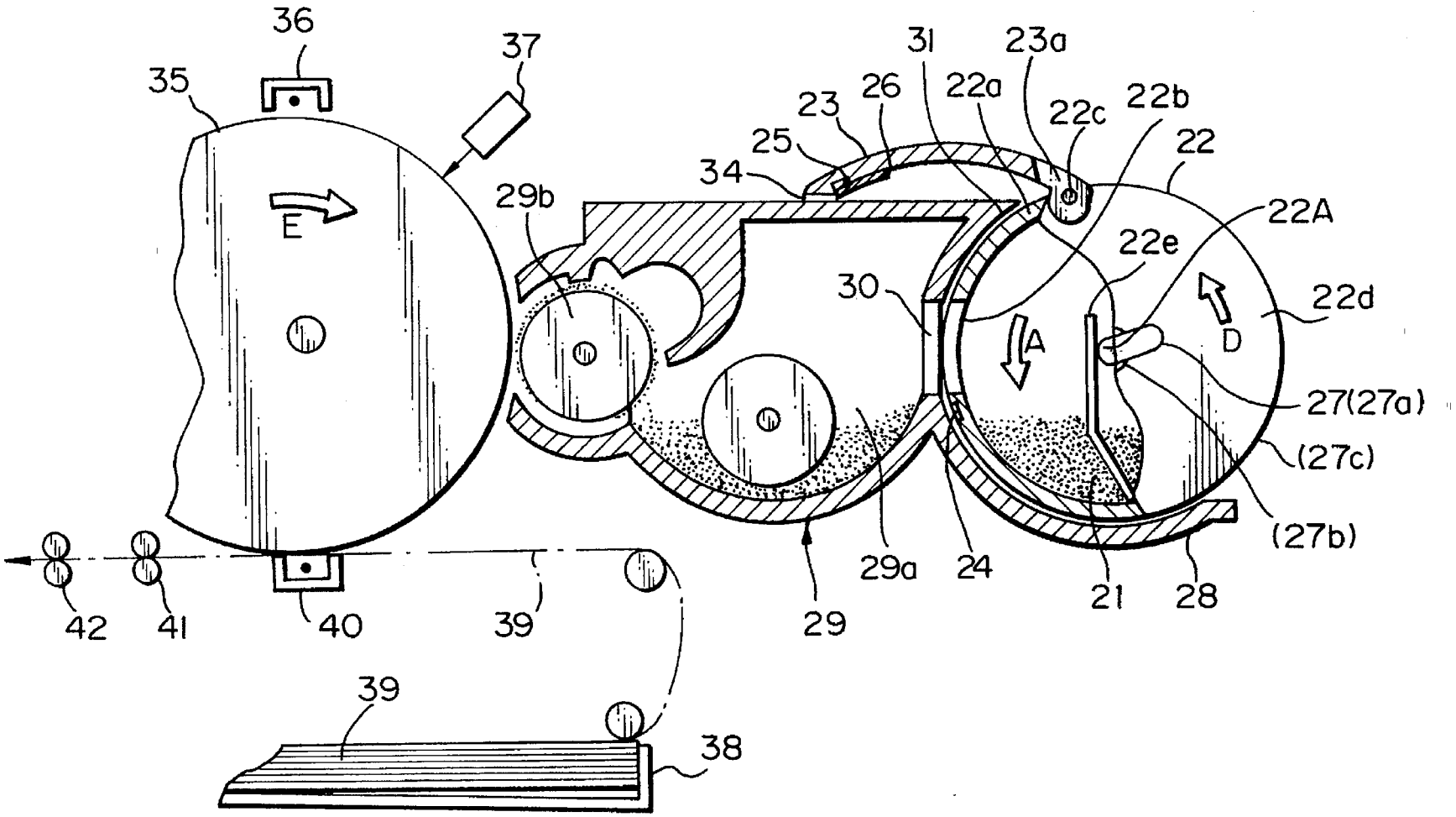
FIG. 6 is a section of a copier to which the cartridge of FIG. 3 is mounted.

FIG. 6 shows a developing unit 29 to which the cartridge having the above configuration is mounted, together with an image forming section adjoining it. As shown, after the container 22 has been mounted to a mount portion 28 contiguous with the developing unit 29, the knob 27*a* is turned in a direction D by hand. As a result, the container 22 is rotated about its own axis integrally with the knob 27*a*. At this instant, the lid 23 is brought into contact with a projection 31 extending out from the upper end of a toner hopper 29*a* which is included in the developing unit 29. The lid 23 is opened by the projection 31 while sliding on the outer periphery of the hopper 29*a*. Hence, the outlet 22*b* of the container 22 is surely uncovered without the toner flowing out or smearing the operator's hand. It is to be noted that the cartridge is initially laid in the mount portion 28 in a position where the lid 23 is not interfered by the mount portion 28, i.e., a position rotated about 90 degrees (angle corresponding to the circumferential length of the lid 23) clockwise from the position shown in FIG. 6.

Subsequently, a copy start switch provided on a control section, not shown, is pressed. In response, the agitator 22*e* coupled to a drive shaft 22A is rotated in a direction A, FIG. 6, to drive the toner 21 out of the container 22 via the outlet 22*b*. The toner 21 is introduced into the developing unit 29.

On the other hand, a photoconductive drum, or image carrier, 35 is rotated in a direction E. A charger 36 uniformly charges the surface of the drum 35. An exposing unit 37 exposes the charged surface of the drum 35 to thereby electrostatically form a latent image thereon. A developing roller, or developer carrier, 29*b* is disposed in the developing unit 29 and develops the latent image to produce a corresponding toner image. The toner image is transferred from the drum 35 to a paper 39 fed from a paper feed unit 38 by an image transfer unit 40. After the toner image has been fixed on the paper 39 by a fixing unit 41, the paper is driven out to a copy tray, not shown, by a discharge roller 42. When the container 22 is turned in the direction D by hand, the lid 23 abuts against the projection 31 of the hopper 29*a*. The free edge of the lid 23 is inclined such that it opens and closes while sliding smoothly on the top of the hopper 29*a*. A cleaning member 34 is fitted on the inclined edge of the lid 23. When the lid 23 slides on the top of the hopper 29*a*, the cleaning member 34 cleans it.

Figure 7:
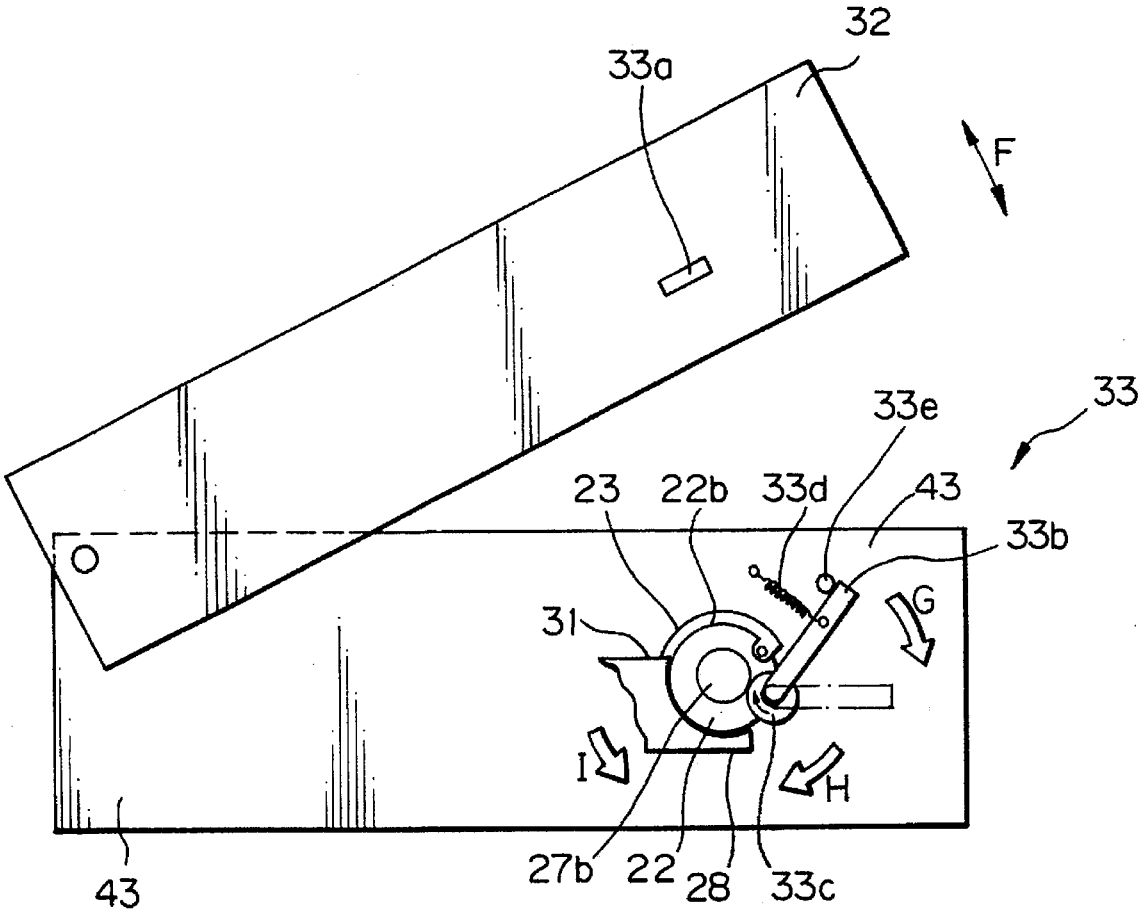
FIG. 7 is a side elevation of a copier to which a modified form of the toner cartridge is mounted.

An alternative embodiment of the present invention will be described with reference to FIG. 7. As shown, the copier is generally made up of a lower casing 43 and an upper casing 32 hinged to the lower casing 43 at one end thereof. The upper casing 32 is opened and closed in a direction F in the event of, e.g., the replacement of parts, paper jam, or loading or unloading of the cartridge. The operator opens the upper casing 32 away from the lower casing 43 in the direction F, sets the container 22 in the mount portion 28, and then closes the upper casing 32 toward the lower casing 43. As a result, the lid 23 is automatically caused to uncover the outlet 21*b* of the container 22. The prerequisite with this embodiment is that the container 22 be provided with the gear 27*b* or 27*c* shown in FIG. 5.

A gear 33*c* is rotatably mounted on the lower or fixed casing 43. An arm 33*b* extends radially outward from the gear 33*c* and is constantly biased counterclockwise by a tension spring 33*d*. The counterclockwise movement of the arm 33*b* is limited by a stop 33*e*. When the container 22 is mounted to the mount portion 28, the gear 33*c* meshes with the gear 27*b* or 27*c* of the container 22. In this condition, the container 22 is rotated in the previously stated manner by a torque transferred from the gear 33*c* to the gear 27*b* or 27*c*. When a presser member 33*a* provided in a suitable position on the upper casing 32 presses the arm 33*b* downward, the arm 33*b* is rotated clockwise against the action of the spring 33*d*.

More specifically, when the upper casing 32 is closed in the direction F, the presser member 33*a* causes the arm 33*b* to rotate clockwise, as indicated by an arrow G, against the action of the spring 33*d*. The arm 33*b*, in turn, causes the gear 33*c* to rotate clockwise, as indicated by an arrow H. The gear 33*c*, meshing with the gear 27*b* or 27*c* of the container, rotates the entire container 22 counterclockwise, as indicated by an arrow I. As a result, the lid 23 is opened by the projection 31, uncovering the outlet 22*b* of the container 22.

To remove the container 22 from the mount portion 28, e.g., in the event of replacement, the upper casing 32 is opened in the direction F. Then, the presser member 33*a* is released from the arm 33*b* with the result that the arm 33*b* and gear 33*c* are rotated counterclockwise by the tension spring 33*d*. This rotates the container 22 clockwise and thereby releases the lid 23 from the projection 31. Consequently, the lid 23 again closes the outlet 22*b*. The stop 33*e* stops the arm 33*b* and allows the container 22 to be removed from the mount portion 28.

With the toner cartridge and copier shown in FIGS. 3–7, it is possible to load the copier with the cartridge by easy operation without smearing the operator's hand or causing the toner 21 to flow out by accident.

In summary, the present invention achieves various unprecedented advantages as enumerated below.

(1) First magnetic particles have a higher charging ability than second magnetic particles. Hence, sufficiently charged toner included in a second developer existing in a developer storing space can efficiently migrate into a first developer deposited on a developer carrier. It follows that even in a high-speed image forming apparatus, the sufficiently charged toner can be fed to a developing region and obviates background contamination and other troubles.

(2) Toner toner is automatically taken in in response to an increase or decrease in the toner concentration attributable to repeated development, so that the toner concentration of the developer on the developer carrier remains substantially constant. This eliminates the need for a toner replenishing mechanism and a toner concentration sensor and thereby implements a miniature and inexpensive developing device.

(3) The first magnetic particles have a greater saturation magnetization than the second magnetic particles. Hence, the first particles contributing to development are strongly attracted by the developer carrier and sparingly allowed to leave it and deposit on an image carrier. This successfully prevents image quality from being lowered by the deposition of the magnetic particles.

(4) Because the force biasing the second magnetic particles toward the developer carrier is smaller than the force biasing the first magnetic particles toward the same, the first developer shaved off by a regulating member is surely moved toward a toner replenishing position due to its own weight in a developer circulating space. This prevents the two different developers from being mixed together.

(5) The first magnetic particles have a smaller weight mean particle size than the second magnetic particles, so that the first developer contributing to development contains a great amount of toner. Therefore, even in a high-speed image forming apparatus, a sufficient image density and thin line reproducibility are achievable.

(6) The first magnetic particles have a lower volume resistivity than the second magnetic particles, so that the resistance of the first developer contributing to development is lowered and provides it with conductivity. As a result, a latent image representative of a solid image has a uniform electric field distribution around its edges. This suppresses the edge effect which would promote the deposition of toner at edges.

(7) When the first developer has the magnetic particles dispersed in a binder resin, it is possible to soften a magnet brush in the developing region. The softened magnet brush can develop a latent image representative of a halftone image in a desirable manner.

(8) When an abrasive is contained in the second developer, it grinds the surfaces of the first magnetic particles of the first developer. This effectively protects the toner to be introduced into the first magnetic particles from a spent state. As a result, the toner is prevented from flying about or smearing the background due to the deterioration of the charging characteristic of the magnetic particles.

(9) When the developer carried on the developer carrier is conveyed toward a position where it will face the opening of a developer holding space, it is partly taken into the space. At the same time, a developer existing in the above space is fed to the developer carrier. Such replacement prevents the developer from being continuously used for development. Hence, even when a smaller amount of developer than conventional is deposited on the developer carrier, short charging and other troubles attributable to the spending of the toner are obviated. In addition, a decrease in the life of the developer due to deterioration is eliminated.

(10) The opening of the developer holding space is disposed below the surface of the developer carrier, so that the developer drops from the developer carrier into the space due to its own weight. This allows the developer to be surely introduced into the above space.

(11) A magnetized body is located in the vicinity of the opening of the developer holding space or within this space and forms a magnetic field. The force of the magnetic field attracts the developer from the image carrier toward the space. This further promotes the introduction of the developer into the space.

(12) In the developer holding space, the developer is circulated or conveyed. As a result, the developer is provided with a uniform distribution before it is fed to the developer carrier.

(13) A fixed magnetic pole is located at a position facing the end of the opening of the developer holding space close to a toner storing space. A magnetic field formed by the magnetic pole attracts the developer toward the developer carrier. This allows the developer to be surely fed from the holding space to the developer carrier.

(14) Further, the field formed by the magnetic pole causes the developer to stand at the end of the opening of the holding space. Hence, despite that the holding space adjoins the toner storing space, the toner in the storing space is blocked and prevented from entering the holding space in an excessive amount. At the same time, the developer in the holding space is prevented from entering the toner storing space.

(15) A toner cartridge has a container formed with an outlet, and a lid mounted on the container. When the lid closes the outlet, the closed condition is surely maintained by a magnetic force acting between a magnetic member adjoining the outlet and a magnetic member provided on the lid. Hence, the cartridge can be mounted to an image forming apparatus without smearing the operator's hand and clothing.

(16) When the lid closes the outlet, sponge provided on the lid deforms and hermetically seals the container. Hence, even if the dimensional accuracy of the lid is low, the lid can surely seal the container.

(17) A knob or similar turning means is provided on the outer circumference or the end of the container. When the knob is turned, the lid automatically opens or closes the outlet. The cartridge is, therefore, simple in structure and needs a minimum number of parts. In addition, the cartridge can be easily mounted to an image forming apparatus.

(18) When the container is mounted to a mount portion and then rotated about its own axis, the lid is automatically opened or closed by an opening and closing portion. This allows the cartridge to be easily and surely mounted to an image forming apparatus without smearing the operator's hand.

(19) The lid is opened toward the outside of the toner storing section and has its outer periphery protected from smears due to the toner. Further, the toner is prevented from depositing on the operator's hand. In addition, the cartridge can be surely mounted to an image forming apparatus.

(20) The outlet of the container is automatically opened or closed in interlocked relation to the opening or closing of an upper casing included in an image forming apparatus. Hence, the cartridge can be easily mounted to the apparatus without any troublesome manipulation.

(21) A cleaning member is fitted on the free edge of the lid. When the lid closes the outlet, the cleaning member cleans the outer periphery of the toner storing section. This prevents the toner existing on the outer periphery of the storing section from depositing on the operator's hand.

Various modifications will become possible for those skilled in the art after receiving the teachings of the present disclosure without departing from the scope thereof.

What is claimed is:

1. A developing device comprising:

a developer carrier having magnetic field forming means therein, and for conveying a developer consisting of toner and magnetic particles deposited on a surface thereof;

a regulating member for regulating an amount of said developer deposited on said developer carrier;

a developer storing space for storing a part of said developer removed by said regulating member; and a toner storing space adjoining said developer storing space at an upstream side with respect to a direction in which said developer carrier conveys said developer, and formed with a toner replenishing opening facing said developer carrier;

wherein said developer consists of a first developer containing first magnetic particles, and mainly deposited in a layer on the surface of said developer carrier, and a second developer containing second magnetic particles different from said first magnetic particles, and stored in said developer storing space in such a manner as to contact said first developer on said developer carrier over a range from said toner replenishing opening to said regulating member, wherein said first magnetic particles have a higher charging ability than said second magnetic particles, and wherein said regulating member is positioned relative to said developer carrier so as to substantially separate said second developer from said first developer.

2. A device as claimed in claim 1, wherein said first magnetic particles have a higher saturation magnetization than said second magnetic particles.

3. A device as claimed in claim 1, wherein said first magnetic particles have a smaller weight mean particle size than said second magnetic particles.

4. A device as claimed in claim 1, wherein said first magnetic particles of said first developer are dispersed in a binder resin.

5. A device as claimed in claim 1, wherein said second developer contains an abrasive.

6. A developing device comprising:

a developer carrier for conveying a developer deposited on a surface thereof and consisting of toner and magnetic particles;

a toner storing space storing toner therein and having an opening facing the surface of said developer carrier;

a developer holding space holding a developer therein and having an opening facing the surface of said developer carrier; and a fixed magnetic pole facing an end of said opening of said developer holding space close to said toner storing space at a position such that the developer on the developer carrier forms a barrier between said developer holding space and said toner storing space.

7. A device as claimed in claim 6, wherein said opening of said developer holding space is positioned below the surface of said developer carrier.

8. A device as claimed in claim 7, further comprising a magnetized body adjoining said position in the vicinity of said opening of said developer holding space or disposed within said developer holding space.

9. A device as claimed in claim 6, further comprising means for circulating or conveying the developer in said developer holding space.

10. A toner cartridge comprising:

a hollow cylindrical container storing toner therein;

an outlet formed in a circumferential wall of said container, and for causing the toner to be discharged therethrough;

a lid pivotally mounted on said circumferential wall of said container, and for selectively opening or closing said outlet;

a first magnetic member fitted on said container and adjoining said outlet; and a second magnetic member fitted on a free edge portion of said lid;

wherein said lid hermetically closes said outlet due to attraction acting between said first magnetic member and said second magnetic member.

11. A cartridge as claimed in claim 10, further comprising sponge fitted on said lid at a position where said lid closes said outlet in close contact with said container.

12. A cartridge as claimed in claim 10, further comprising turning means provided on a surface of said circumferential wall of said container or on one end of said container, and for causing said container to be rotated about an axis thereof.

13. An image forming apparatus for forming a toner image by feeding toner from a toner cartridge mounted to a developing device to a latent image electrostatically formed on an image carrier, wherein said toner cartridge comprises a hollow cylindrical container storing toner therein, an outlet formed in a circumferential wall of said container, and for causing said toner to be discharged therethrough, a lid pivotally mounted on said circumferential wall of said container, and for selectively opening or closing said outlet, a first magnetic member fitted on said container and adjoining said outlet, and a second magnetic member fitted on a free edge portion of said lid, wherein said lid hermetically closes said outlet due to attraction acting between said first magnetic member and said second magnetic member, and wherein said developing device comprises a mount portion for mounting said container in a rotatable manner, a toner replenishing opening formed in said mount portion and facing said outlet of said container, and a portion for selectively opening or closing said lid when said container is rotated about an axis thereof.

14. An apparatus as claimed in claim 13, wherein said lid opens toward the outside of said toner storing space of said developing device.

15. An apparatus as claimed in claim 13, wherein when an upper casing forming a part of said apparatus is opened upward away from a lower casing on which said developing device is mounted, said lid is automatically moved to close said outlet, and wherein when said upper casing is closed downward toward said lower casing, said lid is automatically moved to open said outlet.

16. An apparatus as claimed in claim 13, wherein said toner cartridge further comprises a cleaning member fitted on said free edge portion of said lid and for cleaning an outer periphery of said toner storing space of said developing device.

17. A developing device comprising:

a developer carrier having magnetic field forming means therein, and for conveying a developer consisting of toner and magnetic particles deposited on a surface thereof;

a regulating member for regulating an amount of said developer deposited on said developer carrier;

a developer storing space for storing a part of said developer removed by said regulating member; and a toner storing space adjoining said developer storing space at an upstream side with respect to a direction in which said developer carrier conveys said developer, and formed with a toner replenishing opening facing said developer carrier;

wherein said developer consists of a first developer containing first magnetic particles, and mainly deposited in a layer on the surface of said developer carrier, and a second developer containing second magnetic particles different from said first magnetic particles, and stored in said developer storing space in such a manner as to contact said first developer on said developer carrier over a range from said toner replenishing opening to said regulating member, wherein said first magnetic particles have a higher charging ability and a lower volume resistivity than said second magnetic particles.

18. A developing device comprising:

a developer carrier for conveying a developer deposited on a surface thereof and consisting of toner and magnetic particles;

a toner storing space storing toner therein and having an opening facing the surface of said developer carrier; and a developer holding space holding a developer therein and having an opening facing the surface of said developer carrier, wherein toner is replenished to the developer on the developer carrier via said opening by being caused to directly contact the developer on the developer carrier, whereby a toner content of the developer on the developer carrier is automatically controlled.

19. A developing device comprising:

a developer carrier for conveying a developer deposited on a surface thereof and consisting of toner and magnetic particles, said developer carrier including magnetic force generating means having magnetic poles arranged such that adjacent magnetic poles are always of opposite polarity;

a toner storing space storing toner therein and having an opening facing the surface of said developer carrier; and a developer holding space holding a developer therein and having an opening facing the surface of said developer carrier.

20. A developing device comprising:

a developer carrier for conveying a developer deposited on a surface thereof and consisting of toner and magnetic particles;

a developer holding space holding a developer therein and having an opening facing the surface of said developer carrier; and a toner storing space storing toner therein and having an opening facing the surface of said developer carrier, wherein said developer holding space and said toner storing space are arranged in the recited order in a direction in which said developer carrier conveys the developer thereon.

* * * * *